US006688945B2

(12) United States Patent
Liu

(10) Patent No.: US 6,688,945 B2
(45) Date of Patent: Feb. 10, 2004

(54) CMP ENDPOINT DETECTION SYSTEM

(75) Inventor: Yuh-Turng Liu, Kao-Hsiung Hsien (TW)

(73) Assignee: Macronix International Co. Ltd., Hsin-Chu (TW)

( * ) Notice: Subject to any disclaimer, the term of this patent is extended or adjusted under 35 U.S.C. 154(b) by 0 days.

(21) Appl. No.: 10/063,135

(22) Filed: Mar. 25, 2002

(65) Prior Publication Data

US 2003/0181135 A1 Sep. 25, 2003

(51) Int. Cl.[7] ..... B24B 1/00

(52) U.S. Cl. ..... 451/6; 451/5; 451/7; 451/285; 451/286; 451/287; 451/53; 356/500

(58) Field of Search ..... 451/6, 7, 5, 53, 451/285–289; 438/692–693; 356/500; 118/664; 156/345.25

(56) References Cited

U.S. PATENT DOCUMENTS 4,927,485 A * 5/1990 Cheng et al. ..... 156/345.25
5,127,196 A * 7/1992 Morimoto et al. ..... 451/7
5,507,870 A * 4/1996 Siebert ..... 118/664
5,658,183 A * 8/1997 Sandhu et al. ..... 451/5
5,775,980 A * 7/1998 Sasaki et al. ..... 451/285
5,870,198 A * 2/1999 Takagi ..... 356/500
6,045,439 A * 4/2000 Birang et al. ..... 451/526
6,146,242 A * 11/2000 Treur et al. ..... 451/6
6,174,224 B1 * 1/2001 Iachine et al. ..... 451/53
6,190,234 B1 * 2/2001 Swedek et al. ..... 451/6
6,299,516 B1 * 10/2001 Tolles ..... 451/287
6,341,995 B1 * 1/2002 Lai et al. ..... 451/6
6,488,568 B1 * 12/2002 Treur et al. ..... 451/6

* cited by examiner

*Primary Examiner*—George Nguyen
(74) *Attorney, Agent, or Firm*—Winston Hsu

(57) ABSTRACT

An endpoint detection system in a CMP apparatus has a polishing platen, a polishing pad covering the polishing platen, a chamber located in the polishing platen, and a gas flow system arranged in a periphery of the chamber. The gas flow system has a gas inlet used to flow dry gas into the chamber and a gas outlet used to evacuate water vapor in the chamber. Since the gas flow system can evacuate the water vapor in the chamber, the problem of contaminants such as water droplets has been solved. The endpoint detection can thus be precisely controlled.

11 Claims, 2 Drawing Sheets

CM P ENDPOINT DETECTION SYSTEM

BACKGROUND OF INVENTION

1. Field of the Invention

The invention relates to an endpoint detection system in a chemical mechanical polishing (CMP) apparatus, and more particularly, to an endpoint detection system utilizing a gas flow system to evacuate water vapor.

2. Description of the Prior Art

When fabricating modern semiconductor integrated circuits (ICs), to prevent subsequent manufacturing processes from being adversely affected, the flatness of each deposition layer of an integrated circuit has to be considered. In fact, most high-density IC fabrication techniques make use of some method to form a planarized wafer surface at critical points in the manufacturing process. One method for achieving semiconductor wafer planarization or topography removal is the chemical mechanical polishing (CMP) process. The CMP process is a well-known technique for removing materials on a semiconductor wafer using a polishing device and polishing slurry. The combination of the mechanical movement of the polishing device relative to the wafer and the chemical reaction of the polishing slurry provides an effective abrasive force with chemical erosion to planarize the exposed surface of the wafer or a layer formed on the wafer.

Please refer to FIG. 1. FIG. 1 is a schematic diagram of an endpoint detection system 10 in a prior art CMP apparatus. The endpoint detection system 10 in the CMP apparatus includes a polishing platen 12 covered with a polishing pad 14. The polishing pad 14 comprises a hard polishing pad 16 and a soft polishing pad 18. The soft polishing pad 18 interfaces with the hard polishing pad 16 and the polishing platen 12 and the hard polishing pad 16 is used in conjunction with polishing slurry 20 to polish a semiconductor wafer 22 disposed on the polishing platen 12. Furthermore, a window 24 is formed in the hard polishing pad 16, and a chamber 26 is formed below the window 24 in the soft polishing pad 18 and the polishing platen 12. This window 24 is positioned such that it has a view of the semiconductor wafer 22 held by a polishing head during a portion of a platen's rotation. A laser interferometer 28 is fixed below the polishing platen 12 in a position enabling a laser beam to pass through the window 24 and than strike the surface of the overlying semiconductor wafer 22 during a time when the window 24 is adjacent the semiconductor wafer 22. Thereafter, the CMP apparatus 10 analyzes the reflected laser beam from the semiconductor wafer 22 to determine the endpoint of the CMP process.

However, there may be contaminants such as coagulated polishing slurry or fine water mist deposited on the bottom surface of the window 24 and exposed surfaces of the chamber 26 in the polishing platen 12 in the endpoint detection system 10 of the prior art CMP apparatus. Thus, the laser beam traveling through the window 24 and the chamber 26 in the polishing platen 12 is scattered by the contaminants. That is, either the laser beam emitted from the laser interferometer 28 or the laser beam reflected from the semiconductor wafer 22 is attenuated. Consequently, the endpoint detection of the CMP process is interfered with and the planarization of the semiconductor wafer 22 cannot be achieved.

SUMMARY OF INVENTION

It is therefore a primary objective of the claimed invention to provide an endpoint detection system in a chemical mechanical polishing (CMP) apparatus to solve the above-mentioned problem.

According to the claimed invention, an endpoint detection system in a CMP apparatus has a polishing platen, a polishing pad covering the polishing platen, a chamber located in the polishing platen, and a gas flow system arranged in a periphery of the chamber. The gas flow system has a gas inlet used to flow dry gas into the chamber and a gas outlet used to evacuate water vapor in the chamber.

It is an advantage of the claimed invention that the endpoint detection system in the CMP apparatus has the gas flow system arranged in a periphery of the chamber so as to evacuate water vapor deposited on the bottom surface of a window or exposed surfaces of the chamber. Thus, the problem of contaminants such as water droplets has been solved and the endpoint of a CMP process can be precisely controlled. Consequently, the yield of the manufacturing process for integrated circuits is substantially improved and the cost of fabrication is significantly reduced.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
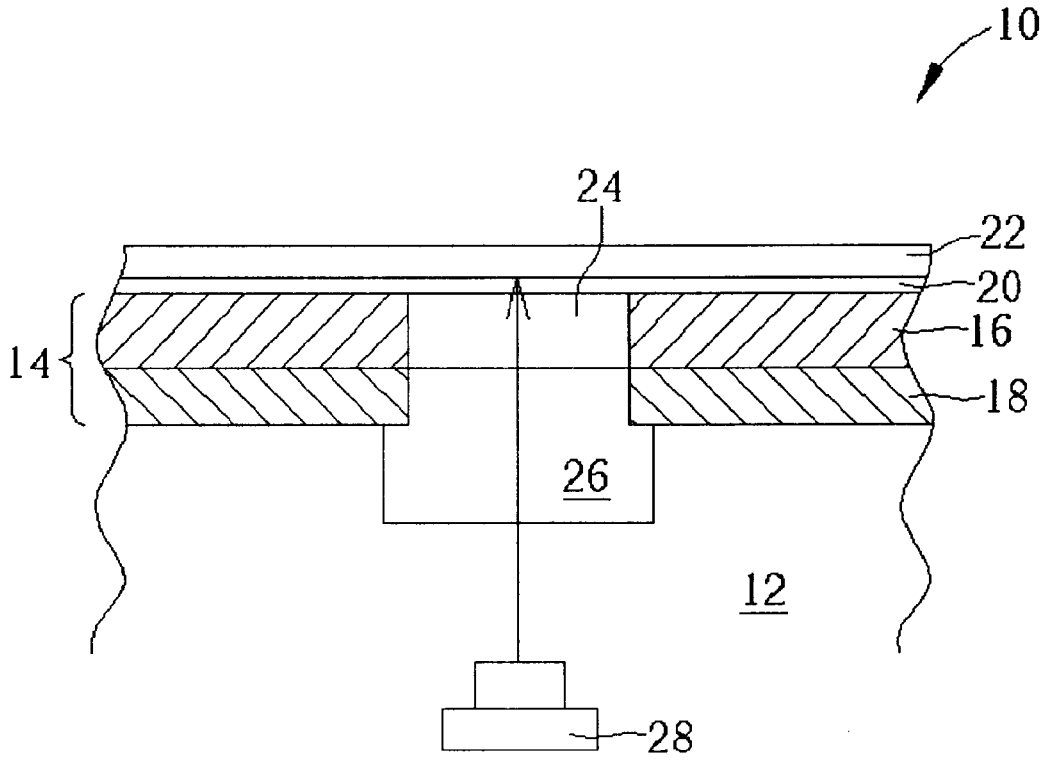
Fig. 1 Prior art
FIG. 1 is a schematic diagram of an endpoint detection system in a chemical mechanical polishing (CMP) apparatus according to the prior art.
Figure 2:
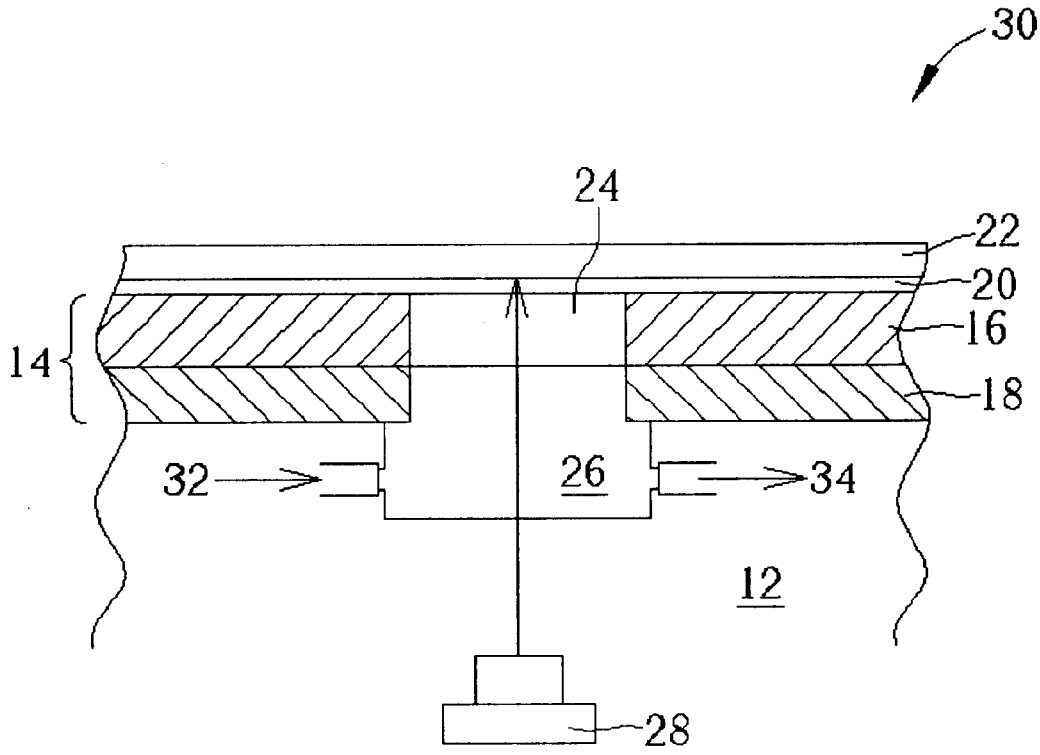
FIG. 2 is a schematic diagram of an endpoint detection system in a CMP apparatus according to the present invention.

Please refer to FIG. 2. FIG. 2 is a schematic diagram of an endpoint detection system 30 in a chemical mechanical polishing (CMP) apparatus according to the present invention. As shown in FIG. 2, the endpoint detection system 30 comprises a polishing platen 12, a polishing pad 14 covering the polishing platen 12, a chamber 26 located in the polishing platen 12, and a gas flow system arranged in a periphery of the chamber 26. The gas flow system has a gas inlet 32 for flowing dry gas into the chamber 26 and a gas outlet 34 for evacuating water vapor in the chamber 26.

According to a preferred embodiment of the present invention, the polishing pad 14 has a bi-layer structure that comprises a hard polishing pad 16 disposed on a top of the polishing pad 14 such as model IC-1000, and a soft polishing pad 18 disposed on a bottom of the polishing pad 14 such as model Suba IV. The soft polishing pad 18 interfaces with the hard polishing pad 16 and the polishing platen 12 and the hard polishing pad 16 is used in conjunction with polishing slurry to polish a semiconductor wafer 22 disposed on the polishing platen 12. Thus, the polishing pad 14 with the bi-layer structure can provide a better planarization and uniformity of the semiconductor wafer 22 in the CMP process. Furthermore, a window 24 is formed in the hard polishing pad 16 overlying the chamber 26. When the window 24 is adjacent to the semiconductor wafer 22, a laser interferometer 28 fixed below the polishing platen 12 can emit a laser beam to pass through the window 24 and strike the surface of the overlying semiconductor wafer 22 so as to perform an endpoint detection process.

Since the CMP process generates contaminants such as water vapor or coagulated polishing slurry deposited on the surfaces of the chamber 26, the endpoint detection system 30 according to the present invention uses the gas flow system arranged in the periphery of the chamber 26 to evacuate the contaminants in the chamber 26. According to the preferred embodiment of the present invention, the dry gas flowed through the gas inlet 32 to the chamber 26 may be nitrogen or clean dry air (CDA). Additionally, also within the spirit of the present invention, the gas outlet 34 of the gas flow system may also be changed into a pump for evacuating water vapor in the chamber 26. Alternatively, the gas flow system of the present invention may be a pump only for pumping out the contaminants in the chamber 26 and thus omit the step of flowing the dry gas from the gas inlet 32 into the chamber 26.

Since there may be contaminants of the coagulated polishing slurry and the fine water mist deposited on the bottom surface of the window and the exposed surfaces of the chamber in the polishing platen, a laser beam traveling through the prior art window is scattered by the contaminants. That is, either the laser beam emitted from the laser interferometer of the endpoint detection system in the CMP apparatus or the laser beam reflected from a semiconductor wafer is attenuated. Consequently, the endpoint detection of the CMP process is interfered with and the planarization of the semiconductor wafer cannot be achieved.

In contrast to the prior art endpoint detection system in the CMP apparatus, the endpoint detection system according to the present invention has a gas flow system arranged in a periphery of the chamber so as to evacuate the contaminants of the water vapor in the chamber via the external power. Thus, the problem of deposits of contaminants in the prior art CMP apparatus can be effectively prevented and then the endpoint of the CMP process can be precisely controlled. Consequently, the yield of the manufacturing process for integrated circuits is substantially improved and the cost of fabrication is significantly reduced.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An endpoint detection system in a chemical mechanical polishing (CMP) apparatus, the endpoint detection system comprising:

a polishing platen;

a polishing pad covering the polishing platen;

a chamber located in the polishing platen;

a lamer interferometer fixed below the polishing platen; and a gas flow system arranged in a periphery of the chamber; wherein the gas flow system comprises a gas inlet for flowing dry gas into the chamber and a gas outlet for evacuating water vapor in the chamber.

2. The endpoint detection system of claim 1 wherein the polishing pad has a bi-layer structure.

3. The endpoint detection system of claim 2 wherein the bi-layer structure of the polishing pad comprises a hard polishing pad disposed on a top of the polishing pad and a soft polishing pad disposed on a bottom of the polishing pad.

4. The endpoint detection system of claim 1 wherein the dry gas is nitrogen.

5. The endpoint detection system of claim 1 wherein the dry gas is clean dry air (CDA).

6. A chemical mechanical polishing (CMP) endpoint detection system comprising:

a polishing platen;

a polishing pad covering the polishing platen;

a chamber located in the polishing platen;

a lamer interferometer fixed below the polishing platen; and a gas flow system arranged in a periphery of the chamber, the gas flow system comprising a pump for evacuating water vapor in the chamber.

7. The CMP endpoint, detection system of claim 6 wherein the polishing pad has a bi-layer structure.

8. The CMP endpoint detection system of claim 7 wherein the bi-layer structure of the polishing pad comprises a hard polishing pad disposed on a top of the polishing pad and a soft polishing pad disposed on a bottom of the polishing pad.

9. The CMP endpoint detection system of claim 6 wherein the gas flow system further comprises a gas inlet for flowing dry gas into the chamber.

10. The CMP endpoint detection system of claim 9 wherein the dry gas is nitrogen.

11. The CMP endpoint detection system of claim 9 wherein the dry gas is clean dry air (CDA).

* * * * *